United States Patent [19]

Haendle

[11] 4,400,823

[45] Aug. 23, 1983

[54] X-RAY DIAGNOSTIC INSTALLATION FOR RADIOGRAPHY AND FLUOROSCOPY

[75] Inventor: Joerg Haendle, Erlangen, Fed. Rep. of Germany

[73] Assignee: Siemens Aktiengesellschaft, Berlin & Munich, Fed. Rep. of Germany

[21] Appl. No.: 273,238

[22] Filed: Jun. 12, 1981

[30] Foreign Application Priority Data

Jul. 2, 1980 [DE] Fed. Rep. of Germany ..... 3025107

[51] Int. Cl.[3] ..... H05G 1/30; H05G 1/46

[52] U.S. Cl. ..... 378/113; 378/115

[58] Field of Search ..... 378/113, 115, 116, 97, 378/138, 99

[56] References Cited

U.S. PATENT DOCUMENTS

| | | | |
|---|---|---|---|
| 1,946,287 | 2/1934 | Kearsley | 378/138 |
| 3,991,314 | 11/1976 | Schmitman | 378/97 |
| 4,158,138 | 6/1979 | Hellstrom | 378/116 |

*Primary Examiner*—Alfred E. Smith
*Assistant Examiner*—T. N. Grigsby
*Attorney, Agent, or Firm*—Hill, Van Santen, Steadman & Simpson

[57] ABSTRACT

An exemplary embodiment includes a television installation for the transmission of the X-ray image, a dose rate device for supplying a dose rate value during fluoroscopy, and a control circuit for controlling the size of the focus of the X-ray tube, to which at least one dose rate value of the dose rate device is supplied. An X-ray tube is present with at least one control electrode for the determination of the focus size via the electrode potential. The control electrode is connected with the control circuit via a control voltage generator. In the control circuit, data is stored which establishes the focus size at the smallest possible value, in dependence upon the dose rate value, the permissible load of the X-ray tube, and upon radiography values.

3 Claims, 2 Drawing Figures

X-RAY DIAGNOSTIC INSTALLATION FOR RADIOGRAPHY AND FLUOROSCOPY

BACKGROUND OF THE INVENTION

The invention relates to an X-ray diagnostic installation for radiography and fluoroscopy with a television installation for the transmission of the X-ray image, comprising a dose rate control device for controlling the dose rate via the voltage and/or the current of the X-ray tube, and comprising a control circuit for controlling the size of the focus of the X-ray tube to which at least one output value of the dose rate control device is supplied. X-ray diagnostic installations of this type are employed for targeted indirect X-ray image intensifier radiographs.

From the German AS 22 45 939 (U.S. Pat. No. 3,991,314 issued Nov. 9, 1976) an X-ray diagnostic installation of the cited type is known, in which a function generator is provided in which various progressions of voltages for the radiograph are programmed-in, in dependence upon the fluoroscopy voltage and the radiographic (or exposure) time, which progressions can be selected by means of keys. From the respective fluoroscopy voltage, the radiography voltage is determined and adjusted in the function generator in dependence upon the selected program. In an associated logic stage, the focus of the X-ray tube, necessary for the radiography voltage, is selected.

Through this arrangement, radiography can proceed immediately following the switching-over from fluoroscopy to radiography. Through the two possible focus sizes, in the case of different loads of the X-ray tube, the focus can be selected which is still permissible given a specified power. The focus size is thereby approximated in steps to the optimum size. What has proven disadvantageous here is that a smallest possible adjustment of the focus size, in general, cannot take place, so that resolution degradations result.

SUMMARY OF THE INVENTION

The invention proceeds from the object of creating a generic X-ray diagnostic installation which, in the case of targeted radiographs, determines from the fluoroscopy values the smallest possible adjustment of the focus size, so that a maximum resolution can be obtained.

In accordance with the invention, this object is achieved in that an X-ray tube with at least one control electrode for the determination of the focus size via the electrode potential is present, which, via a control voltage generator, is connected with the control circuit, and that, in the control circuit, data are stored which fix the focus size to the smallest possible value, respectively, in dependence upon the initial value, the permissible load of the X-ray tube, and upon radiography values. Through this continuous alteration of focus size, the smallest focus for the respective instance can be adjusted, and thus the greatest resolution can be obtained.

In utilizing an X-ray tube having several focuses, the adjustment range of the focus size control can be additionally expanded if the control circuit is so designed that, in addition to controlling the electrode potentials, it selects one of the cathodes producing the focuses. A simple construction can be achieved if the control circuit exhibits an arithmetic unit with which the electrode potential is computed from the fluoroscopy values, from the stored values of the maximum load of the X-ray tube, and from the radiographic (or exposure) values preselected on the operating console by adjustment means. It has proven expedient for the arithmetic unit of the control circuit to be comprised of a microprocessor.

The invention shall be explained in greater detail in the following on the basis of an exemplary embodiment illustrated on the accompanying drawing; and other objects, features and advantages will be apparent from this detailed disclosure and from the appended claims.

DETAILED DESCRIPTION

Figure 1:
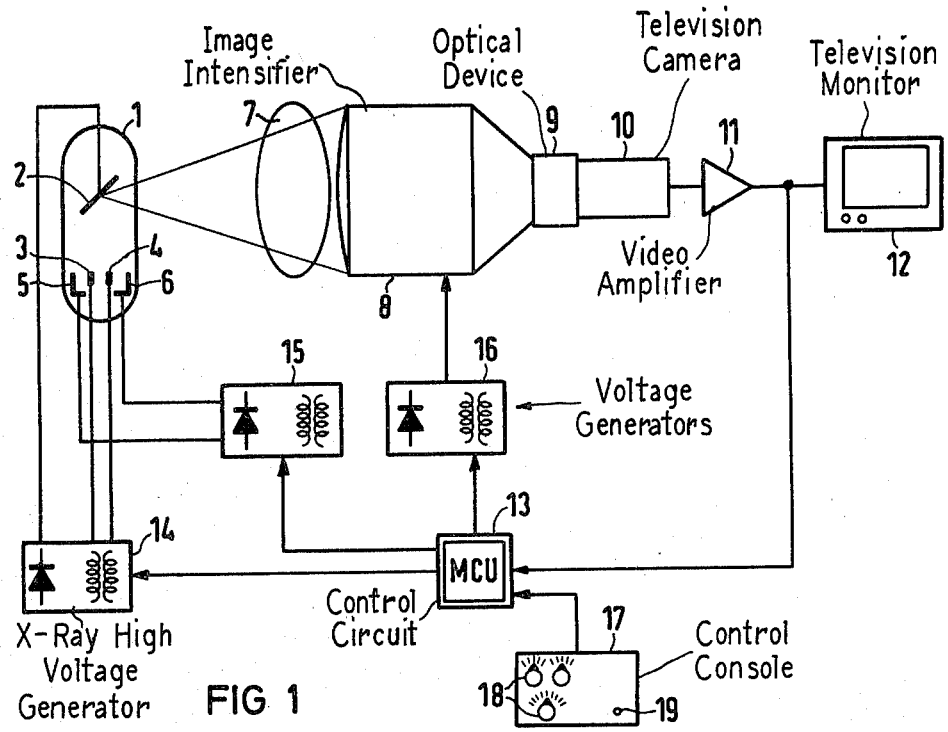
FIG. 1 illustrates a block circuit diagram of an inventive X-ray diagnostic installation.

In FIG. 1, an X-ray tube 1 with an anode 2 and two cathodes 3 and 4 is illustrated. The cathodes 3 and 4 are surrounded by control electrodes 5 and 6. Through the two locally offset cathodes 3 and 4, two focuses on the anode 2 of the X-ray tube 1 are produced. A radiation beam, issuing from the anode 2, passes through the patient 7 and impinges on the inlet fluoroscent screen of an X-ray image intensifier 8. The image of the outlet fluorescent screen is transmitted by an optical device 9 to a television camera 10 whose output signal is amplified in a video amplifier 11. The output of the video amplifier 11 is connected with a monitor 12 on which the television image can be observed. The video signal is further supplied to a control circuit 13 which influences an X-ray high voltage generator 14 for the supply of anode voltage to the X-ray tube 1, a control voltage generator 15 for the control electrodes 5 and 6, and an electrode voltage generator 16 for the electron optics of the X-ray image intensifier 8. Via a control console 17 with adjustment means 18, it is possible to supply correction values, set point values, and adjustment values to the control circuit 13. For example, with the adjustment means 18, the voltage values and current values, and the magnification (or enlargement) factor for the imaging of the exposed inlet field of the X-ray image intensifier on the outlet fluorescent screen can be selected. A radiography key 19 effects a changeover switching of the X-ray diagnostic installation from fluoroscopy operation to radiography operation.

Through the arrangement of the two cathodes 3, 4 with the control electrodes 5, 6, surrounding them, a required influencing of the size and of the intensity of the electron beam, and hence of the focus can take place. In the case of a two-angle tube employed here, through the activation of one of the cathodes 3, 4, by the X-ray generator 14, different radiation angles are obtained. Resulting herefrom are mutually different performance characteristics and sizes of the optical focal spot, since the focal spot, given a constant size of the cathode, becomes smaller through reduction of the obliqueness of the angle of incidence of the electron beam on the anode. Conditioned thereby, the thermal focal spot is likewise reduced, so that, given a small focus, only minimum powers can be handled. In addition to the selection of the cathodes, through potentials connected to the control electrodes 5 and 6, which potentials are generated by the control voltage generator 15, the electron emission of the cathodes 3, 4, can be varied, as a consequence of which the area of the optical focal spot can be continuously reduced.

Figure 2:
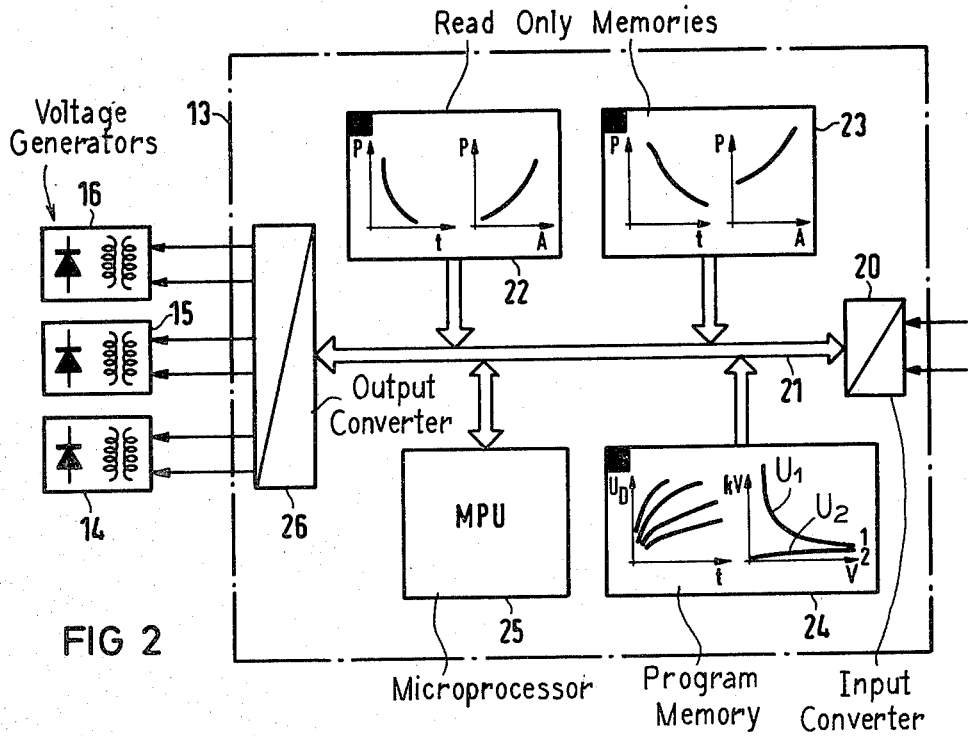
FIG. 2 illustrates a block circuit diagram of the control circuit of FIG. 1.

On the basis of FIG. 2, the construction and the method of operation of the control circuit 13 shall now be explained in greater detail, which, in this instance, is constructed in the form of a microcomputer.

The input of the control circuit 13 is formed by an input converter 20 which is subjected to the output signals of the video amplifier 11 and of the operating console 17. The input converter 20 can be comprised of an A/D-converter and registers. It adapts the input signals to the data channel (bus 21) connected with it. Two read only memories 22 and 23, for example PROM's (programmable read only memories), store digital data according to the curve progressions (illustrated within the blocks 22 and 23 in FIG. 2) for the maximum power of the two focuses, in dependence upon time duration of X-ray tube operation, $P=f(t)$, and upon the focus area, $P=f(A)$, and are connected with the bus 21. The read only memory 22 is associated with the small focus (e.g. as produced by cathode 3) and the read only memory 23 is associated with the large focus of the X-ray tube 1 (e.g. as produced by cathode 4). In a program memory 24, which can likewise be designed in the form of a PROM, for example, the voltage progressions of the X-ray generator 14, $U=f(U_A, U_D, t)$, and of the electrode voltage generator 16, $U_1, U_2=f(V)$, which are selectable by the adjustment means 18, are stored. This signifies: that the voltage U of the X-ray generator 14 is a function of the fluoroscopy voltage $U_D$, the adjusted radiography voltage $U_A$, and the time t. The voltages $U_1$ and $U_2$ of the electrodes of the electron optics of the X-ray image intensifier 8 are dependent upon the intensification factor V in the illustrated fashion. Via the bus 21 the memories 22, 23, 24 are connected with a microprocessor (MPU) 25 which controls the functional sequences of the control circuit 13.

From the input data, supplied by the input converter 20, and the values contained in the memories 22, 23, 24, the microprocessor 25 calculates the necessary voltage values for the X-ray generator 14, the electrode voltage generator 16, and the control voltage generator 15, and selects the associated focus. The computed values are supplied to the output converter 26 which exhibits, for example, registers and a D/A-converter. The output converter 26 effects the adaptation to the X-ray generator 14 and the voltage generators 15 and 16, connected with it via two lines each. Each of the double lines leading to generators 14 and 15 can here directly operate a respective circuit associated with a respective one of the cathodes 3 or 4; however, one of the lines, respectively, serves as control line for the purpose of switching over the generator to one of the electrodes 5 or 6, whereas the other line excites and activates the one-part generator in this instance.

During fluoroscopy, the output of the video amplifier 11 supplies a signal to input converter 20 of the control circuit 13 representing (e.g. by its average amplitude) the actual value of the dose rate. Subsequent to conversion (e.g. to a digital average value for each dose rate sampling interval) in the input converter 20, the actual value is supplied to the microprocessor 25 which regulates the dose rate during the fluoroscopy operation. For this purpose, there is adjusted (or set), at the control console 17, via the adjustment means 18, the necessary set point value for the dose rate which is compared with the actual value in the microprocessor 25. From the adjustment means 18 of the operating console 17, also a value is supplied to the input converter 20 which characterizes the magnification (or enlargement) factor of the X-ray image intensifier 8. The microprocessor 25 computes the necessary correction of the generator voltages and correspondingly influences, via the output converter 26, the generators 14 through 16.

Simultaneously the microprocessor 25 determines, from the fluoroscopy voltage, in dependence upon the selected transfer characteristic, the radiography values, the focus size, and the kV-value. The transfer characteristic for the radiography voltage from the fluoroscopy voltage and a correction factor for an automatic exposure timer can be programmed manually selectable or, however, also (bodily) organ-related. Via additional transmitters, which, for example, characterize the distance of the focus to the radiation receiver, the inlet field of the X-ray image intensifier, and the aperture of the iris diaphragm to the television camera, the radiography values, in particular, the focus sizes can be corrected. The size of the inlet field of the X-ray image intensifier 8, can, however, also be computed by the microprocessor 25 from the magnification (or enlargement) factor selectable by the adjustment means 18. In an additional memory, furthermore, the sensitivity of the television pick-up tube 10 and the radiation quality can be stored for the purpose of correction of the computed radiography values.

For an indirect X-ray image intensifier radiograph, the section to be radiographed is observed and selected during the fluoroscopy. Simultaneously the radiography values are computed from the fluoroscopy voltage. If through actuation of the radiography key (or manipulator) 19, the X-ray diagnostic installation is now switched to radiography, through the previous computation of the radiography values from the fluoroscopy voltage and through the intermediate storage in the registers of the output converter 26, the generators can be immediately switched over, so that the radiography can proceed immediately. The values necessary for the radiography are thereby automatically calculated and adjusted from the manually adjusted values and the fluoroscopy voltage. Through the activation of the control voltage generator 15, the electron emission of the switched-on cathode is influenced, so that the associated focus is continuously variable. If the tube power exceeds the maximally permissible power for this focus, the other cathode and the associated focus are then likewise automatically selected, which focus can still be varied in its dimensions.

Instead of tapping off the actual value of the dose rate from the video amplifier 11, a photomultiplier can be coupled to the optical device 9, which photomultiplier supplies the necessary values to the input converter 20 of the control circuit 13.

During the radiography, the control circuit 13 functions as an automatic exposure timer; i.e., for the purpose of completing a radiograph, when the dose required for an optimum image density (or blackening) has been attained, the control circuit 13 switches off (or disconnects) the radiograph. Either the X-ray tube 1 can now be completely disconnected, or a switchover to fluoroscopic operation can again be effected.

Through the described X-ray diagnostic installation, indirect radiographs can be obtained which possess a maximum of resolution capability. This is important, in particular, in the case of electronic radiographs through digital methods, since the system resolution is considerably greater than in the case of conventional systems. Otherwise, the good properties of the electronic image recording would not be fully exploited.

It will be apparent that many modifications and variations may be effected without departing from the scope of the novel concepts and teachings of the present invention.

I claim as my invention:

1. An X-ray diagnostic installation for radiography and fluoroscopy comprising: an X-ray tube, a television installation for the transmission of the X-ray image, focus size control means for controlling the size of the focus of the X-ray tube, and dose rate means for generating at least one output value during fluoroscopy, said focus size control means comprising at least one control electrode (5, 6) for determining the focus size via the electrode potential, a control voltage generator (15) connected with the control electrode for controlling the electrode potential, and a control circuit (13) connected with said control voltage generator (15), said control circuit having storage means (22, 23) for storing said fluoroscopy output value, the maximum load for said X-ray tube, and selected radiography values, said control circuit further having an arithmatic unit connected to said storage means for computing an electrode potential based on the contents of said storage means for operating said control voltage generator for establishing a focus size during radiography which is substantially the smallest the value in combined dependence upon said output value, said maximum load of the X-ray tube (1), and said selected radiography values, and an operating console (17) connected to said control circuit (13) having an adjustment means (18) for manual selection of said radiography values.

2. An X-ray diagnostic installation according to claim 1 wherein said X-ray tube has a plurality of cathodes (3, 4), and wherein the control circuit (13) is operative both for selecting one of the cathodes (3, 4) for producing a corresponding focus, and for controlling an electrode potential which acts on an electron beam issuing from the selected cathode.

3. An X-ray diagnostic installation according to claim 1, wherein the arithmatic unit of the control circuit (13) is a microprocessor (25).

* * * * *